US010216125B2

(12) United States Patent
Ogura et al.

(10) Patent No.: US 10,216,125 B2
(45) Date of Patent: Feb. 26, 2019

(54) SOLID LUBRICANT, SOLID LUBRICANT APPLICATION APPARATUS AND IMAGE FORMING APPARATUS

(71) Applicant: Konica Minolta, Inc., Tokyo (JP)

(72) Inventors: Kunihiro Ogura, Hino (JP); Yukio Hosoya, Tama (JP); Taiki Amemiya, Hachioji (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 15/879,641

(22) Filed: Jan. 25, 2018

(65) Prior Publication Data

US 2018/0217539 A1 Aug. 2, 2018

(30) Foreign Application Priority Data

Jan. 31, 2017 (JP) ..... 2017-016037

(51) Int. Cl.

| | |
|---|---|
| ***G03G 15/20*** | (2006.01) |
| ***C10M 107/28*** | (2006.01) |
| ***C11D 9/08*** | (2006.01) |
| ***C10M 107/02*** | (2006.01) |
| ***C10M 169/04*** | (2006.01) |
| ***G03G 21/00*** | (2006.01) |

(52) U.S. Cl.

CPC ..... *G03G 15/2025* (2013.01); *C10M 107/02* (2013.01); *C10M 107/28* (2013.01); *C10M 169/04* (2013.01); *C11D 9/08* (2013.01); *G03G 21/0094* (2013.01); *C10M 2205/04* (2013.01); *C10M 2207/126* (2013.01); *C10M 2209/084* (2013.01); *C10M 2213/0623* (2013.01); *C10N 2210/02* (2013.01); *C10N 2220/082* (2013.01); *C10N 2240/203* (2013.01); *C10N 2250/08* (2013.01); *G03G 21/0011* (2013.01); *G03G 2215/00531* (2013.01)

(58) Field of Classification Search

None

See application file for complete search history.

(56) References Cited

U.S. PATENT DOCUMENTS

| | | | | |
|---|---|---|---|---|
| 2005/0042000 | A1* | 2/2005 | Sato | G03G 21/0011 399/299 |
| 2006/0120773 | A1* | 6/2006 | Itami | G03G 5/04 399/302 |
| 2008/0124155 | A1* | 5/2008 | Mimbu | G03G 15/161 399/346 |
| 2009/0060600 | A1* | 3/2009 | Ninomiya | G03G 15/75 399/346 |
| 2009/0311016 | A1* | 12/2009 | Shinshi | G03G 15/2025 399/329 |
| 2011/0158677 | A1* | 6/2011 | Kikuchi | G03G 15/161 399/101 |

(Continued)

FOREIGN PATENT DOCUMENTS

JP 2016138925 A 8/2016

*Primary Examiner* — Sevan A Aydin

(74) *Attorney, Agent, or Firm* — Lucas & Mercanti, LLP

(57) ABSTRACT

A solid lubricant to be applied onto an image carrier of an image forming apparatus of an electrophotographic system, includes a metal soap and resin particles, and the resin particles have a particle main body constituted by a rigid resin other than fluorine-based resins, and fluorine atoms carried on the surface of the particle main body.

6 Claims, 3 Drawing Sheets

(56) References Cited

U.S. PATENT DOCUMENTS

| | | | | |
|---|---|---|---|---|
| 2011/0206430 | A1* | 8/2011 | Arai | B08B 1/00 399/346 |
| 2011/0229234 | A1* | 9/2011 | Hozumi | G03G 15/161 399/357 |
| 2012/0195660 | A1* | 8/2012 | Yamada | G03G 21/0005 399/346 |
| 2014/0102235 | A1* | 4/2014 | Wakugawa | F16H 57/039 74/425 |
| 2018/0210374 | A1* | 7/2018 | Yagi | G03G 5/075 |

* cited by examiner

SOLID LUBRICANT, SOLID LUBRICANT APPLICATION APPARATUS AND IMAGE FORMING APPARATUS

The entire disclosure of Japanese patent Application No. 2017-016037, filed on Jan. 31, 2017, is incorporated herein by reference in its entirety.

BACKGROUND

Technological Field

The present invention relates to a solid lubricant, a solid lubricant application apparatus and an image forming apparatus.

Description of the Related Art

As an image forming apparatus of an electrophotographic system such as a printer, an image forming apparatus having an image carrier (hereinafter also referred to as "photosensitive body"), a cleaning apparatus for removing a transfer residual toner from a surface of the photosensitive body by allowing an elastic member (hereinafter also referred to as "cleaning member") to abut on the surface, and a solid lubricant application apparatus for applying a solid lubricant onto the surface of the photosensitive body, is known. The above-mentioned solid lubricant application apparatus has, for example, an application member having elasticity and being abuttably disposed on the surface of the photosensitive body, a solid lubricant, and a bias member for biasing the solid lubricant toward the application member to allow the solid lubricant to abut on the application member. This solid lubricant contains, for example, a metal soap containing a higher aliphatic acid metal salt as a major component and a tetrafluoroethylene oligomer whose terminal groups have been treated with fluorine (for example, see JP 2016-138925 A).

In the image forming apparatus as mentioned above, the solid lubricant is applied onto the surface of the photosensitive body, and a film of the solid lubricant is formed. By such film of the solid lubricant, both the wearing of the surface of the photosensitive body and the wearing of the cleaning member such as a cleaning blade are suppressed in the above-mentioned image forming apparatus.

However, in the above-mentioned image forming apparatus, in general, the thickness of the film of the solid lubricant on an image part onto which toner particles adhere on the surface of the photosensitive body is thinner than the thickness of the film of the solid lubricant on a non-image part onto which toner particles do not adhere, after the passage of the cleaning blade. Furthermore, if a difference is generated in the thickness of the film of the solid lubricant on the surface of the photosensitive body, a partial difference may be generated in the abrasion force of the cleaning blade on the photosensitive body, and thus a partial difference may be generated in the wearing amounts of the photosensitive body and the cleaning blade. Therefore, desired lifetime(s) of one or both of the photosensitive body and the cleaning blade may not be achieved, and decrease in image quality due to the wearing of these photosensitive body and cleaning blade may occur.

Such decrease in image quality is considered to be a more significant problem in the above-mentioned image forming apparatus in printing industry, for which the level of demand for image quality is high and in which identical printed products are continuously printed in large numbers. Accordingly, in an image forming apparatus of an electrophotographic system in which a solid lubricant is applied onto an image carrier, there still is a room for consideration from the viewpoint of prevention of the above-mentioned decrease in image quality due to the difference in thickness in the film of the solid lubricant.

SUMMARY

An object of the present invention is, in an image forming apparatus of an electrophotographic system having a cleaning apparatus and an image carrier, wherein a solid lubricant is applied onto the surface of the image carrier, to provide a technique to suppress the difference in the thickness of a film of the solid lubricant on the surface of the image carrier to thereby suppress the decrease in image quality due to the wearing of the image carrier and the wearing of an elastic member for cleaning abutting on the image carrier.

To achieve the abovementioned object, according to an aspect of the present invention, a solid lubricant to be applied onto an image carrier of an image forming apparatus of an electrophotographic system, reflecting one aspect of the present invention comprises a metal soap and resin particles, and the resin particles have a particle main body constituted by a rigid resin other than fluorine-based resins, and fluorine atoms carried on the surface of the particle main body.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Figure 1:
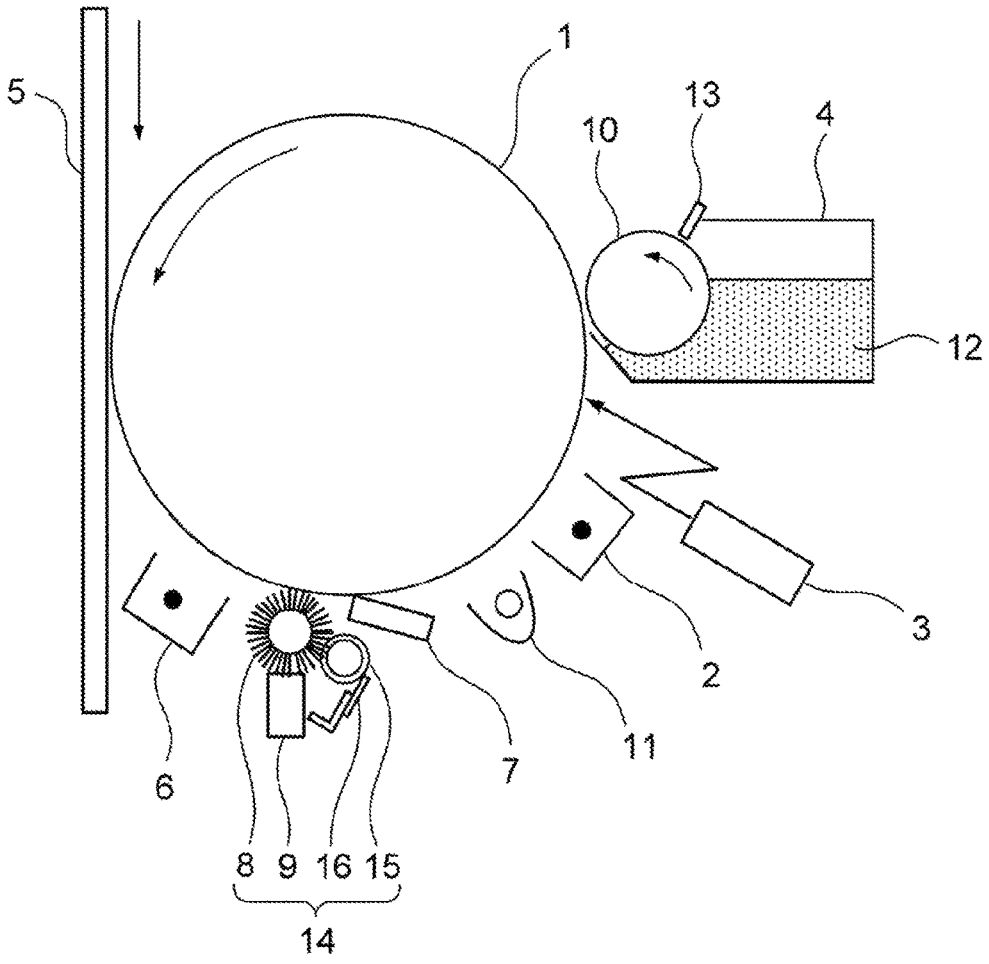
FIG. 1 is a schematic drawing showing a part of the constitution of an image forming apparatus according to an embodiment of the present invention.

Hereinafter, one or more embodiments of the present invention will be described with reference to the drawings. However, the scope of the invention is not limited to the disclosed embodiments.

The solid lubricant according to an embodiment of the present invention contains a metal soap and resin particles.

The above-mentioned metal soap can be appropriately selected from metal soaps that are known in a solid lubricant to be applied onto a photosensitive body in an image forming apparatus of an electrophotographic system. The above-mentioned metal soap may be one or more kind(s). Examples of the above-mentioned metal soap include aliphatic acid metal salts formed by binding a metal such as calcium, magnesium, lead, zinc, copper or iron to a straight chain hydrocarbon such as myristic acid, palmitic acid, stearic acid or oleic acid. Among these, zinc stearate is specifically preferable from the viewpoint that it has a high effect to decrease the friction coefficient of the image carrier.

The above-mentioned resin particles each has a particle main body constituted by a rigid resin other than fluorine-based resins, and fluorine atoms carried by the surface of the particle main body.

The above-mentioned fluorine atoms may be chemically bonded to the surface of the above-mentioned resin particle, or may be physically carried by an interaction by intermolecular force or the like. In a case where the above-mentioned fluorine atoms are chemically bonded to the resin particle, the above-mentioned fluorine atoms may be contained in the structural unit of the resin that constitutes the surface of the resin particle, or may be appropriately bonded via a specific functional group.

Furthermore, it is sufficient that the above-mentioned fluorine resin is present on the surface of the above-mentioned resin particle, or the fluorine resin may be present in the inner side of the resin particle within the scope where a desired hardness in the resin particle is exerted. The abundance ratio (content) of the above-mentioned fluorine atoms on the surface of the above-mentioned resin particle is calculated as a measured value of the fluorine element when the elements that are deemed to present on the surface of the particle are quantitatively analyzed, or as a calculated value of the concentration of the targeted fluorine element on the surface of the particle which is calculated from respective atomic peak surface areas by using a relative sensitivity factor. The elements that are deemed to be present on the surface of the particle may be all of the elements that are actually present on the surface of the resin particle, or may be only typical elements containing fluorine. For example, the above-mentioned elements that are deemed may be elements other than hydrogen which constitute the resin such as carbon and oxygen.

The abundance ratio of the fluorine atoms that are present on the surface of the resin particle is preferably 5 atom % or more, more preferably 10 atom % or more, from the viewpoint of sufficiently suppressing the wearing in the above-mentioned cleaning nip part. Furthermore, the above-mentioned content is preferably 60 atom % or less, more preferably 50 atom % or less from the viewpoint of maintenance of the hardness of the above-mentioned particle. The abundance ratio of the above-mentioned fluorine atoms on the surface of the above-mentioned resin particle can be obtained by an X-ray photoelectron spectroscopy (XPS).

It is preferable that the above-mentioned resin particles have a suitable size, from the viewpoint of suppressing the wearing of the photosensitive body and cleaning member at a cleaning nip part. For example, the volume average particle size of the above-mentioned resin particles is preferably 30 nm or more from the viewpoint of suppression of the wearing of the cleaning blade. Furthermore, the above-mentioned volume average particle size is preferably 300 nm or less, more preferably 200 nm or less from the viewpoint of suppression of damaging such as chipping of the cleaning blade. When the above-mentioned volume average particle size is less than 30 nm, the above-mentioned resin particles are fit in the fine convexes and concaves on the surface of the photosensitive body, and thus the resin particles become difficult to roll on the surface, and the effect to decrease the wearing of the cleaning blade may be decreased. Furthermore, when the above-mentioned volume average particle size exceeds 300 nm, chipping of the cleaning blade by coarse particles may occur.

Furthermore, the coefficient of variation (CV value) of the particle diameter of the above-mentioned resin particles can be obtained from the following formula, and is preferably 20% or less, more preferably 15% or less.

Coefficient of variation($CV$ value: %)=100×(Standard Deviation/Average Particle Size)

The volume average particle size and CV value of the above-mentioned resin particles can be obtained by, for example, a laser diffraction/scattering particle size distribution measurement apparatus ("LA-960" (manufactured by Horiba, Ltd.)).

It is preferable that the above-mentioned resin particles have appropriate roundness from the viewpoint of suppression of the wearing of the photosensitive body and the cleaning member at the cleaning nip part. For example, it is preferable that the average degree of circularity of the above-mentioned resin particles is 0.9 or more from the above-mentioned viewpoints.

The average degree of circularity of the above-mentioned resin particles can be obtained by processing an image photographed under a transmission electron microscope. For example, the above-mentioned resin particles are photographed under "JEM-2000FX" (manufactured by JEOL, Ltd.), a picture image is scanned by using a scanner, the above-mentioned resin particles are subjected to an image thresholding processing by using an image processing analyzer "LUZEX AP" (manufactured by Nireco Corporation), degrees of circularity were calculated for 100 resin particles, and an average degree of circularity can be obtained as the average value thereof.

The above-mentioned rigid resin has sufficient hardness for retaining the shape of the above-mentioned resin particles at an abutting part (hereinafter also referred to as "cleaning nip part") between the photosensitive body and the cleaning member abutting on the photosensitive body in the image forming apparatus of an electrophotographic system. Generally, it is preferable that the above-mentioned resin particles have an M-scale hardness by Rockwell hardness in view of the maintenance of the shape in the cleaning nip part and polishing on the photosensitive body.

The above-mentioned rigid resin has a small particle size, and thus it is difficult to measure the hardness itself. However, for example, it is possible to relatively confirm hardness by measuring the above-mentioned Rockwell hardness by an element having the same composition as that of the resin particles. Furthermore, for example, it is possible to confirm that the resin particles have a desired hardness by observing the particle shape of the above-mentioned resin particles under a condition of a nip pressure at the cleaning nip part, and to observe that the particle shape is substantially changed.

The weight average molecular weight (Mw) of the above-mentioned rigid resin is preferably 5,000 or more in a case where the molecular weight is measured by gel permeation chromatography (GPC) by using a polystyrene standard, from the viewpoint of suppression of the wearing of the photosensitive body and the cleaning member at the cleaning nip part. Furthermore, the above-mentioned Mw is preferably 500,000 or less from the viewpoint that the above-mentioned wearing suppression effect reaches a ceiling, and from the viewpoint of easy availability.

The above-mentioned resin particles may be formed of only the above-mentioned particle main body, or may be particles each having a core-shell structure having the particle main body as a core. In a case where the above-mentioned resin particles are particles each having a core-shell structure, it is preferable that the particle main body as a core part has the above-mentioned hardness, and it is preferable that the particle main body has a volume average particle size of 30 nm or more. The volume average particle size of the above-mentioned particle main body can be appropriately determined by subtracting the thickness of the shell part from the desired volume average particle size of the above-mentioned resin particles. The hardness of the above-mentioned particle main body can be confirmed by observing that the shape of the particle main body in the core-shell structure is substantially not changed under the condition of the above-mentioned nip pressure.

It is sufficient that the above-mentioned resin particles have a desired hardness, and that predetermined fluorine atoms are present on the surface. Such resin particles have a true density of preferably 1.3 or less. If the true density is higher than 1.3, the effect of the rigid resin that constitutes at least the center parts of the resin particles is lost, and thus an adverse effect due to the insufficient hardness of the resin particles may occur.

For the measurement of the true density of the particles, a measurement method of a gas substitution system by helium is used. The true density can be measured by using a measurement apparatus Accpyc 1330 (manufactured by Shimadzu Corporation). The measurement method is as follows. A precisely-measured measurement sample is put in a stainless cell having an inner diameter of 18.5 mm, a length of 39.5 mm and a capacity of 10 $cm^3$. The volume of the micropowder (the measurement sample of the resin particles) in the sample cell is then measured by the change in the pressure of helium, and the true density of the resin particles can be obtained from the obtained volume and the weight of the sample.

The above-mentioned rigid resin can be appropriately selected from resins such that the resins themselves, or when the resins are formed into particles, the resins can sufficiently express desired physical properties such as the above-mentioned particle size, hardness and the like, and may be either one kind or two or more kinds. The above-mentioned rigid resin is not specifically limited, and compositions mainly containing an acrylic resin or a styrene resin are preferable from the viewpoint that particles having homogeneous particle diameters are easily produced, and that the particles are suitable for being formed into microparticles.

Examples of the acrylic resin include homopolymers or copolymers of acrylic acid or esters thereof, methacrylic acid or esters thereof, acrylic acid derivatives such as acrylamide, methacrylamide, acrylonitrile and methacrylonitrile, and the like.

Examples of the styrene resin include homopolymers of styrene-based monomers such as styrene and styrene derivatives, and copolymer resins of a styrene-based monomer as a major component with a vinyl compound that can be copolymerized with the styrene-based monomer. Examples of the styrene-based monomers include aromatic vinyl compounds such as styrene, α-methylstyrene, p-chlorostyrene, p-methylstyrene and vinylnaphthalene.

The above-mentioned one or more resins selected from the acrylic resins and the styrene resins include a styrene-acrylic resin. The styrene-acrylic resin is a copolymer of a styrene-based monomer and an acryl-based monomer, and the polymerization format thereof is not limited.

The resin that constitutes the above-mentioned shell part in a case where the above-mentioned resin particles are particles each having a core-shell structure may be the same as or different from the resin that constitutes the particle main body (core part). Examples of the fluorine-containing resin that constitutes the shell part include fluorine resins such as fluoroalkyl (meth)acrylates.

The above-mentioned fluoroalkyl (meth)acrylate is a compound having a fluoroalkyl group having 1 to 20 carbon atoms in which a part or all of the hydrogen atoms in the (meth)acrylate has/have been substituted with fluorine atom(s), and examples of the above-mentioned (meth)acrylate include methyl (meth)acrylate, ethyl (meth)acrylate, propyl (meth)acrylate, n-butyl (meth)acrylate, isobutyl (meth)acrylate, pentyl (meth)acrylate, hexyl (meth)acrylate, heptyl (meth)acrylate, octyl (meth)acrylate, nonyl (meth) acrylate, decyl (meth)acrylate, dodecyl (meth)acrylate, glycidyl (meth)acrylate, cyclohexyl (meth)acrylate, stearyl (meth)acrylate and 2-ethylhexyl (meth)acrylate.

Specifically, examples of the above-mentioned fluoroalkyl (meth)acrylate include trifluoroethyl (meth)acrylate, tetrafluoropropyl (meth)acrylate, hexafluoropropyl (meth) acrylate, octafluoropentyl (meth)acrylate and heptadecafluorodecyl (meth)acrylate.

Furthermore, the resin that constitutes the above-mentioned shell part is a resin other than fluorine resins, and may also be a resin possessing a fluorine-containing compound. For example, the above-mentioned resin may be a dried, solidified product of a resin emulsion containing a fluorine-based surfactant, and more specifically, the resin may be a resin that constitutes a resin layer formed by applying the above-mentioned resin emulsion on the surface of each core particle.

The resin particles each having a core-shell structure may be either a synthesized product or a commercially available product. The method for polymerizing the resin particles is not specifically limited, and can be produced by a conventionally-known production method such as suspension polymerization, dispersion polymerization, seed polymerization or the like. For example, the above-mentioned resin particles can be constituted by a vinyl-based polymer formed by polymerizing a monomer component containing a compound having at least one or more vinyl group(s) in one molecule, and the combination of the monomer components that constitute the core part and the shell part may be a combination in which the monomer that constitutes the shell part and the monomer that constitutes the core part are the same compound or different compounds.

Furthermore, examples of the above-mentioned commercially available product having a core-shell structure include "Finesphere FS-701" (manufactured by Nipponpaint Industrial Coatings Co., Ltd., "Finesphere" is a registered trademark of Nipponpaint Co., Ltd.).

The content of the above-mentioned metal soap in the above-mentioned solid lubricant can be appropriately determined within a scope in which the effect of the present embodiment can be obtained, and is preferably 70% by mass or more, more preferably 80% by mass or more in view of moldability and easiness of cracking.

The content of the above-mentioned resin particles in the above-mentioned solid lubricant can be appropriately determined in a scope in which the effect of the present embodiment can be obtained. The above-mentioned content is preferably 0.5% by mass or more, more preferably 1% by mass or more from the viewpoint of suppression of the wearing of the cleaning blade. Furthermore, the above-mentioned content is preferably 30% by mass or less, more preferably 20% by mass or less in view of cleaning property. When the above-mentioned content is less than 0.5% by mass, the amount of the resin particles that pass through specifically a nip part in a non-image part is too small, and thus a function of a roller by the resin particles is sometimes insufficient, and consequently, suppression of wearing of the cleaning blade is sometimes insufficient. When the abovementioned content is greater than 30% by mass, the removal of the resin particles by the cleaning blade is insufficient, and thus the cleaning property by the cleaning apparatus is sometimes insufficient.

The above-mentioned solid lubricant may further contain other components other than the above-mentioned metal soap and the above-mentioned resin particles within a scope that the effect of the present embodiment can be obtained.

The above-mentioned solid lubricant can be produced by a known method. For example, the above-mentioned solid lubricant can be produced by mixing a metal soap and a resin particles, melting the mixture by heating and injecting the molten mixture in a mold, and then solidifyng the molten mixture by cooling. Furthermore, the solid lubricant can be produced by mixing a metal soap and resin particles, and compression-molding the mixture.

The above-mentioned solid lubricant is applied onto a photosensitive body in an image forming apparatus of an electrophotographic system. The lubricant can be fed to the photosensitive body by a known method. For example, by mixing the lubricant as an external additive with a toner, this toner is fed to a surface of a photosensitive body before being developed, and then uniformly leveled by a cleaning member, whereby the lubricant can be applied onto a surface of a photosensitive body. Irrespective of the differentiation of an image part and a non-image part on the surface of the photosensitive body, it is preferable that the solid lubricant is applied onto the surface of the photosensitive body by using a solid lubricant application apparatus for applying the solid lubricant, from the viewpoint of sufficient and stable feeding of the solid lubricant to the entirety of the surface of the photosensitive body.

The image forming apparatus and the solid lubricant application apparatus in an embodiment of the present invention will be explained below. The image forming apparatus of the present embodiment can be constituted similarly to a known image forming apparatus of an electrophotographic system having a photosensitive body, a cleaning apparatus and a solid lubricant application apparatus. The solid lubricant application apparatus of the present embodiment can be constituted similarly to a known solid lubricant application apparatus, except that the solid lubricant of the present embodiment mentioned above is used.

FIG. 1 is a schematic drawing showing a part of the constitution of the image forming apparatus according to an embodiment of the present invention. As shown in FIG. 1, the image forming apparatus of the present embodiment has a photosensitive body 1, a charging apparatus 2, an exposing apparatus 3, a developing apparatus 4, an intermediate transfer body 5, a charging apparatus 6, a solid lubricant application apparatus 14, a cleaning apparatus and a pre-exposing apparatus 11.

The photosensitive body 1 falls within the image carrier mentioned above, and is, for example, a known organic photosensitive body. The photosensitive body 1 has a drum-shaped substrate (electroconductive carrier) made of aluminum, and a photosensitive layer disposed on the outer periphery surface. The photosensitive layer is, for example, a layer made of a resin having a thickness of 25 μm containing a polycarbonate resin, and a photosensitive material such as a charge-generating compound or a charge transfer compound. The photosensitive body 1 is rotatively disposed, and the rotation velocity is, for example, 460 mm/sec.

The charging apparatus 2 is a non-contacting type charging apparatus by corona discharging. Furthermore, the exposing apparatus 3 includes, for example, an apparatus for irradiating laser beam, and an optical system for forming an optical path of the laser beam, which is not illustrated.

The developing apparatus 4 has a developing sleeve 10 that is disposed opposing to the photosensitive body 1, and a developing blade 13 that defines the layer thickness of a toner carried on the surface of the developing sleeve 10, and houses a two-component developer 12. The toner particles that constitute the two-component developer 12 have toner base particles having a volume average particle size of 6.5 μm produced by a emulsification polymerization process, and inorganic microparticles of silica or titania that have been externally added to the toner base particles as an external additive. Furthermore, the above-mentioned toner particles have negative chargeability.

The intermediate transfer body 5 is an endless belt formed of a polyimide resin to which electroconductivity has been imparted. During the transfer of a toner image, the belt is brought into contact with the photosensitive body 1 by being pressurized by a transfer roller, which is not illustrated.

The charging apparatus 6 is disposed on the lower stream side of the transfer roller in the rotational direction of the photosensitive body 1, and is, for example, a non-contact type charging apparatus by corona discharging.

The solid lubricant application apparatus 14 is disposed on the lower stream side of the charging apparatus 6 in the rotational direction of the photosensitive body 1. The solid lubricant application apparatus 14 has a rotation brush 8, a solid lubricant 9, a flicker 15 and a scraper 16.

The rotation brush 8 is an electroconductive fur brush constituted by electroconductive polyester fibers standing on the surface of the rotation axis. The rotation brush 8 has a brush hair length of 3 mm. The brush hair has a thickness of 3d (denier), and the brush hair has a density of 180 (kF/inch$^2$). Furthermore, the roller diameter is 14 mm. The rotation brush 8 is disposed at a position where the tip parts of the brush hair have digged into the surface of the photosensitive body 1 by, for example, 0.8 mm, and rotates in the order direction at a relative velocity θ: 1.3 with respect to the photosensitive body 1.

The solid lubricant 9 is the solid lubricant of the present embodiment mentioned above. The solid lubricant 9 has an elongated cuboid shape having a similar length to the drum length (the length of the brush part in the axial direction of the rotation brush 8) of the photosensitive body 1 and having a cross-sectional surface that traverses the longitudinal direction of a rectangular shape, and is biased toward the rotation brush 8 by a spring (for example, at a spring pressure of 0.7 N/m), which is not illustrated, to thereby abut on the rotation brush 8.

The flicker 15 abuts on the rotation brush 8 at the position between the photosensitive body 1 and the solid lubricant 9 at the upper stream side of the rotational direction of the rotation brush 8, at a digging amount of, for example, 1 mm. The flicker 15 is, for example, a cylinder made of a metal. The scraper 16 abuts on the surface of the flicker 15. The scraper 16 removes grouts, and the adhered substances (for example, the solid lubricant 9 and the like) on the surface of the flicker 15 from the surface.

The above-mentioned cleaning apparatus has a cleaning container, which is not illustrated, and a cleaning blade 7 supported by the opening of the cleaning container. The solid lubricant application apparatus 14 is disposed inside of the opening of the above-mentioned cleaning container, and the cleaning blade 7 is disposed on the lower position of the stream side than the solid lubricant application apparatus 14 in the rotational direction of the photosensitive body 1.

The cleaning blade 7 is a plate having elasticity, and is, for example, a plate made of an urethane rubber having a modulus of repulsion elasticity of 24% (25° C.), a JIS A hardness of 72°, a thickness of 2.00 mm, a free length of 10 mm, and a width of 324 mm. The cleaning blade 7 abuts at one of the side edge thereof on the entirety of the longitudinal direction of the photosensitive body 1. The cleaning blade 7 has an abutting load of 25 N/m and an abutting angle of 18° with respect to the photosensitive body 1. The pre-exposing apparatus 11 is a light irradiation apparatus, and is disposed between the cleaning blade 7 and the charging apparatus 2.

The charging apparatus 2 applies a voltage onto the surface of the rotating photosensitive body 1. The surface of the charged photosensitive body 1 is irradiated with laser beam from the exposing apparatus 3, whereby an electrostatic latent image that corresponds to an image to be formed is formed on the surface of the photosensitive body 1.

The developing sleeve 10 is driven by rotation at a line velocity of 800 mm/min, and a bias voltage having similar polarity to that of the potential of the surface of the photosensitive body 1 is applied. The developing apparatus 4 is negatively charged during the stirring and transportation of the two-component developer 12 toward the developing sleeve 10. The developing apparatus 4 conducts reversal development by the two-component developer 12 by applying the above-mentioned bias voltage to the developing sleeve 10. The toner particles in the two-component developer 12 adhere to the above-mentioned electrostatic latent image, whereby the electrostatic latent image is developed.

The intermediate transfer body 5 is pressurized to contact with the surface of the photosensitive body 1 carrying a toner image, and a voltage having opposite polarity to the charging polarity of the toner is generally applied by the above-mentioned transfer roller. By this way, the toner image on the surface of the photosensitive body 1 is transferred onto the surface of the intermediate transfer body 5. The transferred toner image is further transferred to a recording medium such as plain paper and then fixed by heating and pressurization by a fixing apparatus, whereby a desired image is formed on the recording medium.

The charging apparatus 6 applies a voltage onto the surface of the photosensitive body 1 after the toner image has been transferred. By the application of this voltage, the polarities of the adhered substances such as the transfer residual toner and the like attached to the surface of the photosensitive body 1 after the transfer are adjusted to be even.

On the other hand, the solid lubricant 9 abutting to the rotation brush 8 by the biasing adheres to the rotation brush 8. The adhered solid lubricant is fed to the charged surface of the photosensitive body 1, whereby the solid lubricant is applied onto the surface of the photosensitive body 1. The adhered substances on the rotation brush 8 are transferred to the flicker 15, scraped from the surface of the flicker 15 by the scraper 16, and housed in the above-mentioned cleaning container.

The cleaning blade 7 abuts to the surface of the photosensitive body 1 on which the solid lubricant has been applied. The transfer residual toner is removed from the surface of the photosensitive body 1 by the cleaning blade 7, and a part of the solid lubricant is scraped off by the cleaning blade 7 and leveled to a predetermined thickness. The transfer residual toner and the solid lubricant that have been scraped off by the cleaning blade 7 are housed in the above-mentioned cleaning container.

The pre-exposing apparatus 11 irradiates the surface of the photosensitive body 1 from which the transfer residual toner has been removed, with light for adjusting the potential on the surface of the photosensitive body 1 to be even. By this way, the electrostatic history of the photosensitive body 1 is deleted from the surface of the photosensitive body 1 until the charging process for forming the next electrostatic latent image.

In the above-mentioned image forming apparatus, the wearing of the photosensitive body 1 and the cleaning blade 7 is suppressed irrespective of the degree of coverage. The reason therefor can be considered as follows.

Figure 2:
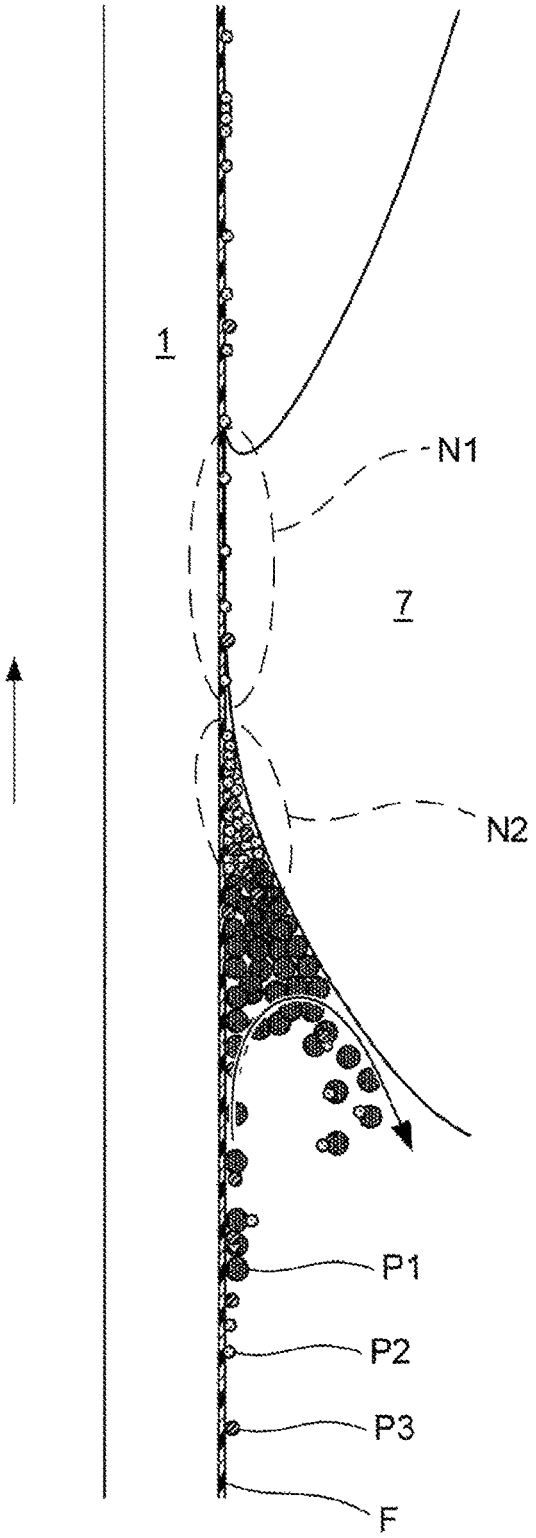
FIG. 2 is an enlarged schematic drawing showing an abutting part between a photosensitive body and a cleaning member and the vicinity thereof in the embodiment.

FIG. 2 is an enlarged schematic drawing showing the cleaning nip part. In FIG. 2, N1 represents a cleaning nip part, which is an abutting part between the cleaning blade 7 and the photosensitive body 1, and N2 represents a space (pooling part) formed by the surface of the cleaning blade 7 and the surface of the photosensitive body 1 that gradually approaches the surface, which is formed on the upper stream side of the photosensitive body 1 in the rotational direction of the photosensitive body 1. Furthermore, P1 represents toner particles, P2 represents an external additive of the toner particles, and P3 represents resin particles in the solid lubricant, respectively. Furthermore, F represents a film of the solid lubricant formed on the surface of the photosensitive body 1.

As mentioned above, the cleaning blade 7 is typically obtained by processing a polyurethane rubber into a sheet form, and is disposed so as to abut in parallel to the periphery surface of the photosensitive body 1 with respect to the axial direction of the photosensitive body 1. During the rotation of the photosensitive body 1, a friction force generates between the photosensitive body 1 and the cleaning blade 7, and the cleaning blade 7 is elastically deformed by such friction force and forms the cleaning nip part N1 at the tip edge part thereof. Furthermore, the pooling part N2 is formed on the upper stream side.

Since the toner particles P1 of the transfer residual toner adhered to the periphery of the photosensitive body 1 are larger than the external additive P2, they are easily scraped off by the cleaning blade 7. On the other hand, the external additive P2 is relatively small and thus easily reaches the pooling part N2. Therefore, a flocculated body (external additive pooling) mainly by the external additive is easily formed in the pooling part N2.

Since a pressing force from the cleaning blade 7 is applied to this external additive pooling, in a case where such external additive pooling is formed, the photosensitive body 1 is generally worn by being scratched by the external additive pooling, and the film F of the solid lubricant on the surface of the photosensitive body 1 is also scraped off, and the photosensitive body 1 then passes through the cleaning nip part N1.

However, in the above-mentioned exemplary embodiment, the resin particles P3 are also fed to the pooling part N2 and the cleaning nip part N1 in the state that the resin particles P3 are adhering to the surface of the photosensitive body 1. By the achievement of the pooling part N2 of the resin particles P3, the ratio of the external additive P2, which is the inorganic particles having high hardness in the external additive pooling, is decreased by the resin particles P3, which have lower hardness than that of the inorganic particles. Accordingly, the wearing of the surface of the photosensitive body 1 by the external additive pooling is alleviated.

Furthermore, in the cleaning nip part N1, the resin particles P3 have sufficient hardness to maintain the particle shape thereof, and the surfaces of the resin particles P3 are slippery due to the existence of the fluorine atoms. Therefore, the resin particles P3 transfer by rolling and slipping on the cleaning nip part N1. Accordingly, the wearing of both of the surface of the cleaning blade 7 and the surface of the photosensitive body 1 by the resin particles P3 are suppressed, and the resin particles P3 pass through the cleaning nip part N1 without applying any stress to the both surfaces.

Furthermore, due to the entering of the resin particles P3 into the external additive pooling, the external additive P2 becomes easy to flow also in the pooling part N2, and thus the external additive P2 becomes easy to pass the cleaning nip part N1 in accordance with the resin particles P3 that are directed to the cleaning nip part N1. Since the external additive P2 also has sufficient hardness, the external additive P2 easily transfers while rolling on the cleaning nip part N1 as in the resin particles P3. Therefore, the wearing of the cleaning blade 7 by the external additive P2 that passes through the cleaning nip part N1 is suppressed.

On the other hand, in a non-image part where the transfer residual toner does not reach, an external additive pooling is not formed. Therefore, the surface of the photosensitive body 1 is not worn by the external additive pooling, the film F of the solid lubricant is not scraped off, and the photosensitive body 1 and the film F pass through the cleaning nip part N1 under such state. Since the film F of the solid lubricant that is thicker than that of the non-image part transfers in the cleaning nip part N1 while the film F is tightly attached to the cleaning blade 7, In the cleaning blade 7 is rubbed by the film F.

However, also in the non-image part, the resin particles P3 in the film F passes through the cleaning nip part N1 without applying any stress on both of the photosensitive body 1 and the cleaning blade 7 as mentioned above. Therefore, also in the non-image part, both of the wearing of the surface of the photosensitive body 1 and the wearing of the surface of the cleaning blade 7 is suppressed.

Accordingly, since the wearing of the surface of the photosensitive body 1 and the wearing of the surface of the cleaning blade 7 are suppressed in similar mechanisms in either of the non-image part and the image part, generation of a difference in the wearing amounts of the non-image part and the image part is also suppressed.

As is apparent from the above-mentioned explanation, the above-mentioned solid lubricant is a solid lubricant to be applied on an image carrier of an image forming apparatus of an electrophotographic system, which contains a metal soap and resin particles, and the resin particles each has a particle main body constituted by a rigid resin other than fluorine-based resins, and fluorine atoms carried on the surface of the particle main body. Furthermore, the above-mentioned solid lubricant application apparatus is a solid lubricant application apparatus for applying a solid lubricant onto a surface of an image carrier in an image forming apparatus of an electrophotographic system, which includes an application member having elasticity, which is abuttably disposed on the surface of the image carrier, a bias member for biasing a solid lubricant toward the application member to allow a solid lubricant to abut on the application member, and the above-mentioned solid lubricant of the present embodiment. Furthermore, the above-mentioned image forming apparatus includes an image carrier, a cleaning apparatus for allowing an elastic member to abut on the surface of the image carrier to remove a transfer residual toner on the surface, and the above-mentioned solid lubricant application apparatus of the present embodiment for applying a solid lubricant onto the surface of the image carrier. Therefore, in an image forming apparatus of an electrophotographic system which has a cleaning apparatus and in which a solid lubricant is applied onto a surface of an image carrier, irrespective of a difference in thickness of the above-mentioned film of the solid lubricant, the decrease in image quality due to the wearing of the image carrier and the wearing of an elastic member for cleaning abutting to the image carrier can be suppressed.

It is further effective that the abundance ratio of the fluorine on the surface of the above-mentioned resin particles is 5 to 60 atom %, from the viewpoint that the wearing of the above-mentioned cleaning nip part is sufficiently suppressed.

Furthermore, it is further effective that the above-mentioned resin particles have a volume average particle size of 30 to 300 nm, from the viewpoint of easiness of entering into the external additive pooling, and from the viewpoint of easiness of passing of the cleaning nip part.

Furthermore, it is further effective that the above-mentioned rigid resin is one or more resins selected from the group consisting of an acrylic resin and a styrene resin, from the viewpoint that the amounts of the external additive and the toner that reach immediately before the cleaning nip part specifically at a high coverage since the rigid resin has high fluidity due to its light specific gravity.

Furthermore, it is further effective that the above-mentioned metal soap is zinc stearate, from the viewpoint that the effect to decrease the friction coefficient of the image carrier is high.

EXAMPLES

[Preparation of Resin Particles 1 to 5]

Resin Particles 1 to 5 were respectively prepared.

Resin Particles 1 are of a developed product manufactured by Nipponpaint Industrial Coatings Co., Ltd., and are resin particles each formed of a core-shell structure. The core parts of Resin Particles 1 are each constituted by an acrylic resin, the shell parts are each made of a fluorine resin, and thus Resin Particles 1 have fluorine atoms on the surfaces. Resin Particles 1 had a volume average particle size D of 60 nm, and when the abundance ratio CF of fluorine on the surfaces of Resin Particles 1 was measured by an X-ray photoelectron spectroscopy (XPS), the fluorine amount was 10 atom %.

The fluorine abundance ratio CF on the surfaces of the resin particles is a measured amount of fluorine obtained by a quantitative analysis of fluorine, carbon and oxygen as selected elements by using an X-ray photoelectron spectrometer "K-Alpha" (manufactured by Thermo Fischer Scientific). The same also applies to Resin Particles 2 to 5.

(Conditions for Measurement)

X-ray: Al monochrome ray source

Acceleration: 12 kV, 6 mA

Resolution: 50 eV

Beam system: 400 μm

Step Size: 0.1 eV

Resin Particles 2 are of a developed product manufactured by Nipponpaint Industrial Coatings Co., Ltd., and are resin particles each formed of a core-shell structure. The core parts of Resin Particles 2 are each constituted by a styrene resin, the shell parts are each made of a fluorine resin, and thus Resin Particles 2 have fluorine atoms on the surfaces thereof. Resin Particles 2 had a volume average particle size D of 100 nm, and the abundance ratio CF of the fluorine on the surfaces of Resin Particles 2 was 32 atom %.

Resin Particles 3 are of a developed product manufactured by Nipponpaint Industrial Coatings Co., Ltd., and are resin particles each formed of a core-shell structure. The core parts of Resin Particles 3 are each constituted by a styrene-acrylic resin, the shell parts are each made of a fluorine resin, and thus Resin Particles 3 have fluorine atoms on the surfaces. Resin Particles 3 had a volume average particle size D of 260 nm, and the abundance ratio CF of the fluorine on the surfaces of Resin Particles 3 was 23 atom %.

Resin Particles 4 are "Dyneon TF9207Z" manufactured by 3M Japan, and are constituted by a low molecular weight PTFE. Resin Particles 4 had a volume average particle size D of 120 nm, and the abundance ratio CF of the surfaces of Resin Particles 4 was 67 atom %.

Resin Particles 5 are "Chemisnow" manufactured by Soken Chemical & Engineering Co., Ltd. ("Chemisnow" is the registered trademark of this company) and are constituted by PMMA. Resin Particles 5 had a volume average particle size D of 200 nm, and the abundance ratio CF of the fluorine on the surfaces of Resin Particles 5 was 0.3 atom %.

The materials and physical properties of Resin Particles 1 to 5 are shown in Table 1.

TABLE 1

| Resin Particles No. | Kind of Resin | D (nm) | CF (atom %) | True Density (g/cm$^3$) |
|---|---|---|---|---|
| 1 | Acrylic resin | 60 | 10 | 1.2 |
| 2 | Styrene resin | 100 | 32 | 1.1 |
| 3 | Styrene-acrylic resin | 260 | 23 | 1.2 |
| 4 | Fluorine resin | 120 | 67 | 2.2 |
| 5 | Acrylic resin | 200 | 0.3 | 1.2 |

[Preparation of Solid Lubricants 1 to 7]

Eighty-eight parts by mass of calcium stearate (CaSt) and 15 parts by mass of Resin Particles 1 were mixed by using a Henshel mixer to give a mixture. The conditions for the mixing were such that the peripheral velocity of the rotation blade was 35 m/sec, the treatment temperature (temperature in bath) was 32° C., and the mixing time (hours) was 3 minutes.

Subsequently, the above-mentioned mixture was injected into a mold at an internal temperature of 160° C. with controlling the temperature so as to not be lowered to 150° C. or less. For 15 minutes, the mold was allowed to stand still while the temperature in the mold was maintained at 150° C., and the mold was then cooled to room temperature (25° C.) at a velocity of 1° C./min with taking care not to generate unevenness in temperature, and the obtained solid was removed from the above-mentioned mold. By this way, Solid Lubricant 1 (8 mm in longitudinal direction×5 mm in traverse direction×328 mm in length) was obtained.

Solid Lubricant 2 was obtained in a similar manner to that for Solid Lubricant 1, except that 92 parts by mass of zinc stearate (ZnSt) was used instead of calcium stearate and the amount of Resin Particles 1 was changed to 8 parts by mass. Furthermore, Solid Lubricant 3 was obtained in a similar manner to Solid Lubricant 2, except that Resin Particles 2 were used instead of Resin Particles 1. Furthermore, Solid Lubricant 4 was obtained in a similar manner to that for Solid Lubricant 3, except that the amount of the zinc stearate was changed to 97 parts by mass and the amount of Resin Particles 2 was changed to 3 parts by mass. Furthermore, Solid Lubricant 5 was obtained in a similar manner to that for Solid Lubricant 2, except that Resin Particles 3 were used instead of Resin Particles 1.

Furthermore, Solid Lubricant 6 was obtained in a similar manner to that for Solid Lubricant 2, except that the amount of the zinc stearate was changed to 92 parts by mass, Resin Particles 4 were used instead of Resin Particles 1, and the amount of the resin particles was changed to 10 parts by mass. Furthermore, Solid Lubricant 7 were obtained in a similar manner to that for Solid Lubricant 2, except that Resin Particles 5 were used instead of Resin Particles 1.

The compositions of Solid Lubricants 1 to 7 are shown in Table 2.

TABLE 2

| Solid Lubricant No. | Metal Soap | Resin Particles No. | Resin Particles Amount (% by mass) |
|---|---|---|---|
| 1 | CaSt | 1 | 15 |
| 2 | ZnSt | 1 | 8 |
| 3 | ZnSt | 2 | 8 |
| 4 | ZnSt | 2 | 3 |
| 5 | ZnSt | 3 | 8 |
| 6 | ZnSt | 4 | 10 |
| 7 | ZnSt | 5 | 8 |

[Solid Lubricant Application Apparatus and Image Forming Apparatus]

As an image forming apparatus of an electrophotographic system, an experimental machine based on a digital print system "bizhub PRESS C1100" manufactured by Konica Minolta, Inc. was prepared. The experimental machine has the constitution as shown in FIG. 1.

[Evaluation 1] Abundance Ratio of Solid Lubricant

Figure 3A:
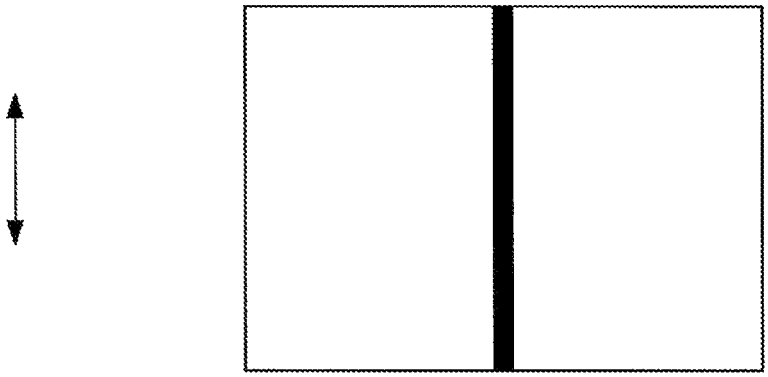
FIG. 3A is a schematic drawing showing an image formed under Condition 1 for the evaluation in Examples.
Figure 3B:
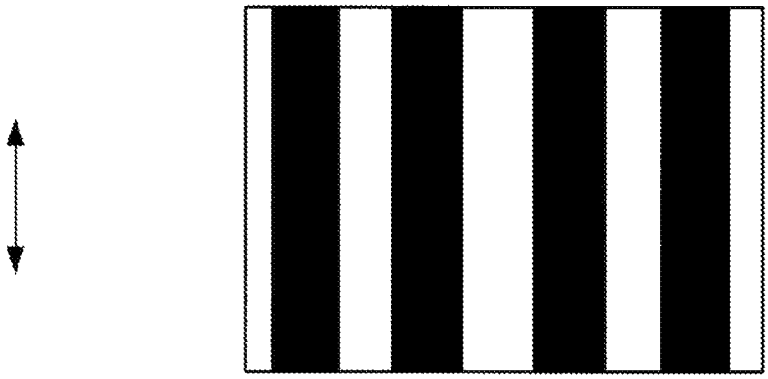
FIG. 3B is a schematic drawing showing an image formed under Condition 2 for the evaluation in Examples.

Using each of the above-mentioned Solid Lubricants 1 to 7 as a solid lubricant for the above-mentioned experimental machine, under each of Condition 1 in which the longitudinal belt chart (total coverage 3.5%) shown in FIG. 3A is prepared under an environment at a high temperature and a high humidity (30° C., 80%), and Condition 2 in which the longitudinal belt chart (total coverage 50%) shown in FIG. 3B is prepared under an environment at a low temperature and a low humidity environment (10° C., 15%), the above-mentioned longitudinal belt chart was prepared on the respective both surfaces of 10,000 sheets of A4 plain paper with setting the paper feeding direction as a traverse direction. The arrow in FIGS. 3A and 3B shows the paper feeding direction.

Furthermore, the abundance ratios (Rws) of the elements inherent to the solid lubricant at a white part (the part where a partial coverage Cn=0%, a non-image part) which is opposite by approximately 180° from the cleaning blade 7 in the photosensitive body 1, and a solid part (the part where a partial coverage Cn=100%, an image part) were obtained by the following method by an XPS analysis, and judged according to the following criteria.

⊙: Rw is 0.6 atom % or more and less than 1.9 atom %

○: Rw is 0.4 atom % or more and less than 0.6 atom %, 1.9 atom % or more and 2.1 atom % or less ×: Rw is less than 0.4 atom % or greater than 2.1 atom %

The abundance ratio of the lubricant refers to the degree of the presence of the aliphatic acid metal salt per a unit surface area of the surface of the photosensitive body. Here, an abundance ratio of a metal derived from an aliphatic acid metal salt on a surface of a photosensitive body measured by an X-ray photoelectron spectrometry (XPS) was used as a substitute amount. For the selected elements to be detected, elements that are deemed to be able to be present on the surface of the photosensitive body surface are selected. In view of detectivity, as the surface layer of the photosensitive body, a photosensitive body containing no metals derived from aliphatic acid metal salts was selected as the photosensitive body of the above-mentioned experimental machine.

Specifically, the surface layer of the photosensitive body after the above-mentioned image had been formed under each environment was cut into a size of 5 mm square or more to collect a measurement sample, the selected elements that are deemed to be present on the surface of the photosensitive body (metal element derived from metal salt, carbon, oxygen, nitrogen, silicon and titanium) were quantitatively analyzed under the following measurement conditions by using an X-ray photoelectron spectrometer "K-Alpha" (manufactured by Thermo Fisher Scientific Ltd.), and the measured amount of the metal element derived from the metal salt was deemed as the abundance ratio of the above-mentioned lubricant. The element for the above-mentioned purpose was Ca for calcium stearate, and Zn for zinc stearate, respectively.

(Measurement Conditions)

X-ray: Al monochrome ray source

Acceleration: 12 kV, 6 mA

Resolution: 50 eV

Beam system: 400 μm

Step size: 0.1 eV

[Evaluation 2] Wearing Amounts of Cleaning Blade and Photosensitive Body

The wearing width W1 of the cleaning blade and the wearing amount W2 of the photosensitive body after an image had been formed under each condition in the evaluation of "the application amount of the solid lubricant" mentioned above were measured, and the results were judged according to the following criteria.

⊙: W1 is less than 6 μm, and W2 is 0.2 μm or less

○: W1 is 6 μm or more and less than 9 μm, or W2 is greater than 0.2 μm and 0.4 μm or less ×: W1 is 9 μm or more, or W2 is greater than 0.4 μm The results of Evaluation 1 are shown in Table 3, and the results of Evaluation 2 are shown in Table 4, respectively.

TABLE 3

| | Solid | Condition 1 | | | | Condition 2 | | | |
|---|---|---|---|---|---|---|---|---|---|
| | | White portion | | Solid portion | | White portion | | Solid portion | |
| | Lubricant No. | Rw (atom %) | Evaluation | Rw (atom %) | Evaluation | Rw (atom %) | Evaluation | Rw (atom %) | Evaluation |
| Example 1 | 1 | 2.1 | ○ | 0.6 | ⊙ | 1.3 | ⊙ | 0.4 | ○ |
| Example 2 | 2 | 1.6 | ⊙ | 0.8 | ⊙ | 1.4 | ⊙ | 0.8 | ⊙ |
| Example 3 | 3 | 1.5 | ⊙ | 1.0 | ⊙ | 1.4 | ⊙ | 0.9 | ⊙ |
| Example 4 | 4 | 1.8 | ⊙ | 1.1 | ⊙ | 1.7 | ⊙ | 0.9 | ⊙ |
| Example 5 | 5 | 2.0 | ○ | 1.3 | ⊙ | 1.7 | ⊙ | 0.9 | ⊙ |
| Comparative Example 1 | 6 | 1.9 | ○ | 0.5 | ⊙ | 1.0 | ⊙ | 0.3 | × |
| Comparative Example 2 | 7 | 2.2 | ○ | 0.5 | ⊙ | 1.4 | ⊙ | 0.2 | × |

TABLE 4

| | Solid | Condition 1 | | | | | | Condition 2 | | | | | |
|---|---|---|---|---|---|---|---|---|---|---|---|---|---|
| | | White portion | | | Solid portion | | | White portion | | | Solid portion | | |
| | Lubricant No. | W1 (μm) | W2 (μm) | Evaluation | W1 (μm) | W2 (μm) | Evaluation | W1 (μm) | W2 (μm) | Evaluation | W1 (μm) | W2 (μm) | Evaluation |
| Example 1 | 1 | 8 | 0.2 | ○ | 1 | 0.4 | ○ | 5 | 0.2 | ⊙ | 1 | 0.4 | ○ |
| Example 2 | 2 | 5 | 0.1 | ⊙ | 2 | 0.3 | ○ | 5 | 0.1 | ⊙ | 3 | 0.3 | ○ |
| Example 3 | 3 | 5 | 0.2 | ⊙ | 2 | 0.2 | ⊙ | 4 | 0.2 | ⊙ | 3 | 0.2 | ⊙ |
| Example 4 | 4 | 7 | 0.2 | ○ | 2 | 0.1 | ⊙ | 6 | 0.1 | ○ | 3 | 0.2 | ⊙ |
| Example 5 | 5 | 8 | 0.1 | ○ | 3 | 0.1 | ○ | 6 | 0.1 | ○ | 3 | 0.3 | ○ |
| Comparative Example 1 | 6 | 7 | 0.1 | ○ | 2 | 0.3 | ○ | 3 | 0.3 | ○ | 1 | 0.5 | × |
| Comparative Example 2 | 7 | 10 | 0.1 | × | 2 | 0.4 | ○ | 7 | 0.2 | ○ | 1 | 0.7 | × |

As is apparent from Tables 3 and 4, in Solid Lubricants 1 to 5, the solid lubricant is sufficiently applied on either of the white part and the solid part on the surface of the photosensitive body in either of an environment at a high temperature and a high humidity and an environment at a low temperature and a low humidity, and also in a case where a linear image (longitudinal belt chart) along the paper feeding direction is formed. Therefore, even in a case where the above-mentioned image is formed under the above-mentioned environment, both of the wearing of the surface layer of the photosensitive body and the wearing of the cleaning blade can be suppressed in both of the white part and the solid part on the surface of the photosensitive body.

On the other hand, in Comparative Example 1, the application amount of the solid lubricant at the solid part on the surface of the photosensitive body is insufficient in the formation of the above-mentioned image under an environment at a low temperature and a low humidity, and the wearing amount of the photosensitive body and the wearing amount of the cleaning blade are large. The reason can be considered that, since the hardness of the resin particles in Solid Lubricant 6 was insufficient, the nip part between the surface of the photosensitive body and the cleaning blade was deformed into a planular shape by the passage of the above-mentioned resin particles, and a space sufficient for the external additive in the above-mentioned toner to roll was not formed in the above-mentioned nip part, the above-mentioned external additive passed while shaving the solid lubricant during the passage through the above-mentioned nip part; therefore, the wearing of the photosensitive body and the cleaning blade in the above-mentioned solid part increased, and thus the photosensitive body and the cleaning blade were worn.

Furthermore, in Comparative Example 2, in the formation of the above-mentioned image under an environment at a high temperature and a high humidity environment, the wearing of the photosensitive body and the cleaning blade at the white part on the surface of the photosensitive body is significant. The reason can be considered that, since fluorine atoms are substantially absent on the surface of the resin particles in Solid Lubricant 7, the photosensitive body and the cleaning blade were worn at the above-mentioned nip part by the resin particles in Solid Lubricant 7 at the white part, and consequently, the photosensitive body and the cleaning blade were worn.

According to an embodiment of the present invention, in the formation of an image by an electrophotographic system using an organic photosensitive body, the wearing of the photosensitive body and the wearing of the cleaning member are suppressed for a long period irrespective of the coverage of an image to be formed. Therefore, according to an embodiment of the present invention, further development of formation of a high quality image by an electrophotographic system is expected.

Although embodiments of the present invention have been described and illustrated in detail, the disclosed embodiments are made for purposes of illustration and example only and not limitation. The scope of the present invention should be interpreted by terms of the appended claims.

What is claimed is:

1. A solid lubricant to be applied onto an image carrier of an image forming apparatus of an electrophotographic system, wherein the solid lubricant comprises a metal soap and resin particles, the resin particles have a particle main body constituted by a rigid resin other than fluorine-based resins, and fluorine atoms carried on the surface of the particle main body, and the abundance ratio of the fluorine on the resin particles is 5 to 60 atom %.

2. The solid lubricant according to claim 1, wherein the resin particles have a volume average particle size of 30 to 300 nm.

3. The solid lubricant according to claim 1, wherein the rigid resin is one or more resins selected from the group consisting of acrylic resins and styrene resins.

4. The solid lubricant according to claim 1, wherein the metal soap is zinc stearate.

5. A solid lubricant application apparatus for applying a solid lubricant onto a surface of an image carrier in an image forming apparatus of an electrophotographic system, wherein the solid lubricant application apparatus comprises:

an application member having elasticity, which is abuttably disposed on the surface of the image carrier, a bias member for biasing a solid lubricant toward the application member to allow the solid lubricant to abut on the application member, and a solid lubricant, wherein the solid lubricant is the solid lubricant according to claim 1.

6. An image forming apparatus of electrophotographic system comprising:

an image carrier;

a cleaning apparatus for allowing an elastic member to abut on the surface of the image carrier to remove a transfer residual toner on the surface; and a solid lubricant application apparatus for applying a solid lubricant onto the surface of the image carrier, wherein the solid lubricant application apparatus is the solid lubricant application apparatus according to claim 5.

* * * * *